United States Patent [19]

Sachs

[11] Patent Number: 4,890,418

[45] Date of Patent: Jan. 2, 1990

[54] ACCESS PANEL ASSEMBLY WITH DOOR AND MULTI-FUNCTIONAL FRAME

[76] Inventor: Steve H. Sachs, 24264 Ocean Ave., Torrance, Calif. 90505

[21] Appl. No.: 220,322

[22] Filed: Jul. 18, 1988

[51] Int. Cl.[4] ..... E06B 3/32

[52] U.S. Cl. ..... 49/463; 49/380

[58] Field of Search ..... 49/463, 380, 465

[56] References Cited

U.S. PATENT DOCUMENTS 3,286,405 11/1966 Schembri ..... 49/463

3,491,486 1/1970 Caruth ..... 49/463

3,792,551 2/1974 Hallas ..... 49/463

*Primary Examiner*—Philip C. Kannan

*Attorney, Agent, or Firm*—Thomas J. Scott

[57] ABSTRACT

An improved access panel assembly including a multi-functional frame which enables the door to be mounted within the frame from either opposing face. Also included is a unique locking mechanism which enables the door to be press-fitted within the frame from either face while firmly retaining the door within the frame. The assembly is fabricated from plastic composition material which is highly resistant to environmental conditions, particularly water and humidity.

12 Claims, 3 Drawing Sheets

ACCESS PANEL ASSEMBLY WITH DOOR AND MULTI-FUNCTIONAL FRAME

BACKGROUND OF THE INVENTION

This invention relates generally to an improvement in access panel assemblies used in building construction to provide access to various utility fixtures most commonly plumbing fixtures. These fixtures are usually embedded in walls, ceilings, and sometimes floors of a structure. Most prior art assemblies are made either of wood or a metallic material such as, 16 gauge tin. The wooden assemblies have a simple form of box frame that is affixed by nails between adjoining joists. A door hinged along one edge to the frame is secured within the frame when closed by a latch. spring clip, or other securing mechanism. Metallic assemblies, those most commonly used in new building structures and to repair damaged access panel assemblies in existing building structures, are constructed of several narrow strips of metal, usually tin, bent and cut to form a box frame. Each side of the metallic frame is comprised of a channel having a wide edge and a narrow edge facing away from the frame opening. Four sharp corners are formed at each of the four corners (two at the wide edge and two at the narrow edge) as a result of cutting and bending the several metal strips. The door is formed from cutting a single large piece of metal which is rotatably connected along one edge to the metal frame by a hinge, typically a piano-hinge. The four corners of the door are also sharp. The sharp corners and edges of these metal assemblies are known to be prone to cut the gloves and hands of installers who work with these units.

Access panels are manufactured in various sizes listed by door size. Most of the assemblies are square but rectangular sizes are also made by manufacturers. The most common sizes used are: 12"×12", 14"×14", 16"×16", 18"×18", and 24"×24", but other larger and smaller sizes are also available.

The prior art metallic assembly with its piano-hinged door is only suitable for installation in the manner shown in FIGS. 1 and 1A. Therefore, when it is damaged due to rust, warping or other malfunction, it must be entirely replaced. This requires removal of surrounding surface-forming material,i.e., plaster, wall-board, or similar material, from around the panel assembly so that it may be removed from the adjoining joists. A new prior art metallic assembly is then secured to the joists and the surrounding surface-forming material is replaced. This replacement procedure is costly and requires excessive time to remove the damaged panel assembly and surface-forming material as well as the time and materials to replace the surface-forming material. Additionally, handling these prior art assemblies presents a safety hazard due to the sharp corners and edges of the metal. After the panel assembly is installed it must then be painted to cover the dingy metallic finish. The new assembly is not as susceptible to rust, warping or other malfunction as the prior art assemblies due to environmental conditions, particularly water and humidity.

Manufacturers of prior art metal access panel assemblies include KARP Associates, Inc., Maspeth, New York and CAD.COR, Lawndale,California.

The subject invention overcomes the limitations of the above-described prior art assemblies while being more resistant to damaging environmental conditions,- particularly water and humidity. It is also easier and safer to handle, requiring less time and materials to install. Further, it can be used in new or existing structures and can even be used to replace a prior art metallic assembly by merely removing the door and hinge, leaving the old frame in place and inserting the new molded frame within the old metallic frame.

SUMMARY OF THE INVENTION

The present invention is an improved access panel assembly with a door and multi-functional frame each fabricated from a plastic composition material to provide a unit which is highly resistant to damage from environmental conditions and which is more safely and easily installed in both new and existing building structures. The manner in which the multi-functional frame is installed is determined by various factors,i. e.,is the structure new or old, is there a prior art metal frame in place, are there adjoining joists accessible for mounting. In new buildings, the assembly may be installed in a manner similar to prior art metallic units. On the other hand, the multi-functional frame may be rotated 180 degrees and installed in existing structures as a replacement for damaged prior art assemblies or to provide an access panel where non existed previously.

Fabrication of the door and one-piece, multi-functional frame is typically of a plastic material such as ABS or high impact styrene. The design of the frame is such that it has a narrow edge on one face and a wide edge on the other face, somewhat similar to prior art units. However, the structure of the frame is such that it is multi-functional in that the door is accomodated for flush mounting with either the narrow edge or the wide edge. The hinge has been eliminated and the molded, rounded corners of the frame and door provide a press-fit assembly which is safer and easier to install and highly resistant to damage from environmental conditions, particularly water and humidity. The flush mounting of the door to either face of the frame is achieved by a unique symmettrical locking mechanism not heretofore known or used in access panel assemblies. Basically, the inner edge of all four sides of the frame opening contains a molded, shallow groove which is equidistantly located from the two faces of the frame. The door contains on its underside pairs of molded protuberances; each pair positioned near opposing edges of the door. The molded protuberances are somewhat resilient so that they deflect when the door is press-fitted into the frame from either face. The protuberances slide into the shallow grooves and hold the door firmly in place.

DESCRIPTION OF THE PREFERRED EMBODIMENT

Figure 1:
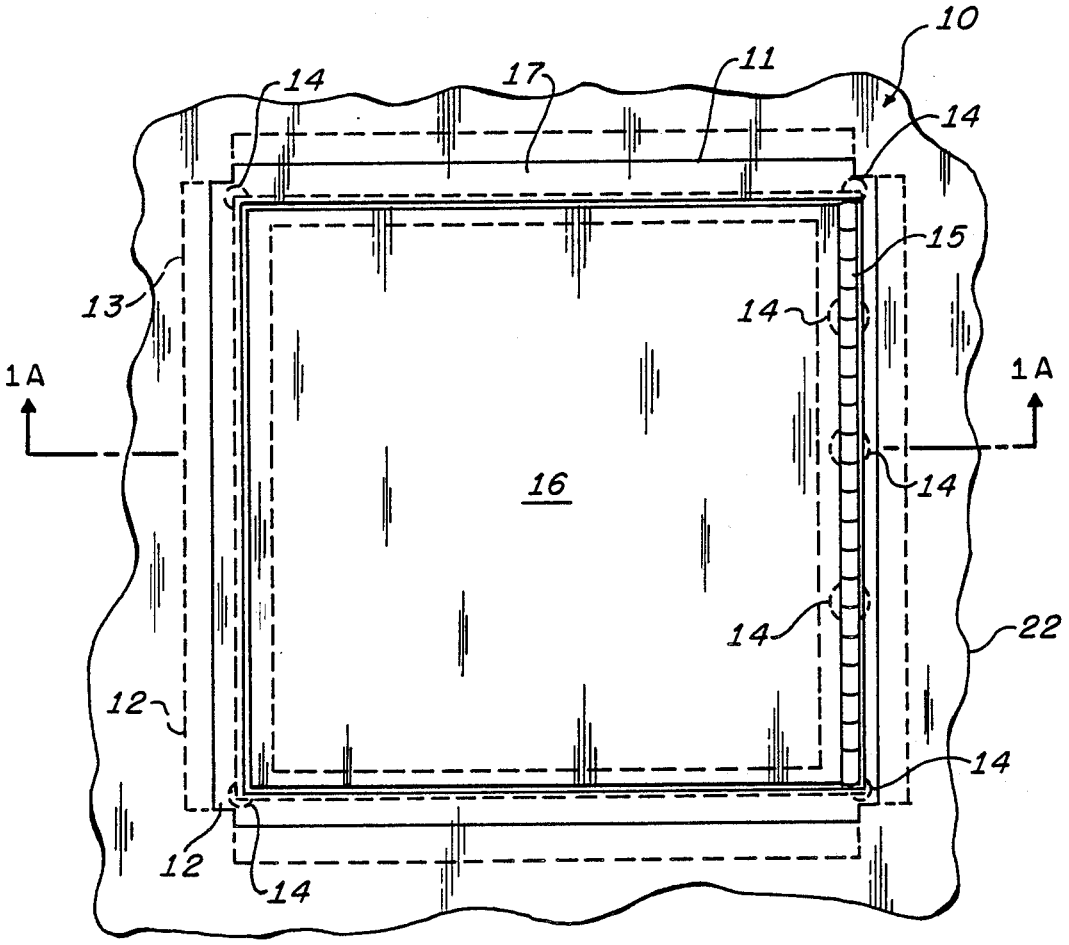
FIG.1. PRIOR ART
FIG. 1 illustrates a prior art metallic panel assembly with the door rotatably hinged to the frame.

FIG. 1 shows a prior art metallic access panel unit which is the most commonly used panel assembly in new building structures. It is also the most commonly used panel assembly to replace damaged assemblies in existing structures, including both older wooden assemblies and previously installed metal assemblies. The prior art assembly 10 includes a frame 11 formed of strips of metal, typically 16 gauge tin, which are cut and bent forming sharp corners 12 and edges 13. Spot welds 14 are used to hold the various strips of metal together forming the frame 11. Attached to the frame 11 is a piano-hinge 15 which is secured thereto by additional spot welds 14. The piano-hinge 15 is also secured to a door 16 by additional spot welds 14. The door 16 is fastened to the frame 11 upon closure by a locking means (not shown) which may include any of a variety of latch mechanisms such as, a cam, cylinder lock, knob turn, paddle handle,etc. The wide edge 18 of the frame 11 is mounted to the adjoining studs or joists 20 and 21 by any suitable means such as a bonding agent, nails etc. Following mounting of the frame 11 to the studs 20 and 21, the surfaceforming material 22, which may be wallboard, plaster or other building material, is positioned around all four sides of the frame 11 in the channel formed between the wide edge 18 and the narrow edge 17. The dingy metallic assembly 10 is then painted to enhance its appearance and blend it in with the surrounding surface-forming material 22.

In practice, prolonged exposure of these panel asemblies to environmental conditions, particularly water and humidity, results in corroding the metal and decomposing the spot welds 14, which hold the frame 11 together, secure the hinge 15 to the door 16, and the frame 11, or secure the latch mechanism to the door 16. As a result, the door 16 warps, causing malfunctioning of the assembly 10, or the latch mechanism separates from the door 16 leaving the door 16 free to swing open. In worse cases, the hing 15 separates from the frame 11 or the door 16 leaving the opening in the frame 11 exposed to the adverse effects of the environment.

Repair of these prior art assemblies requires replacement of the entire assembly 10. In order to remove the frame 11, the surface-forming material 22 must be cleared away from the channels of the frame 11 to permit removal of the old frame 11 and installation of a new frame 11. Then the surface-forming material 22 must be replaced requiring additional time and materials as well as handling the sharp corners and edges of the metallic assembly 10. Again, the dingy metallic appearance of the assembly 10 must be painted to be more attractive.

Figure 2:
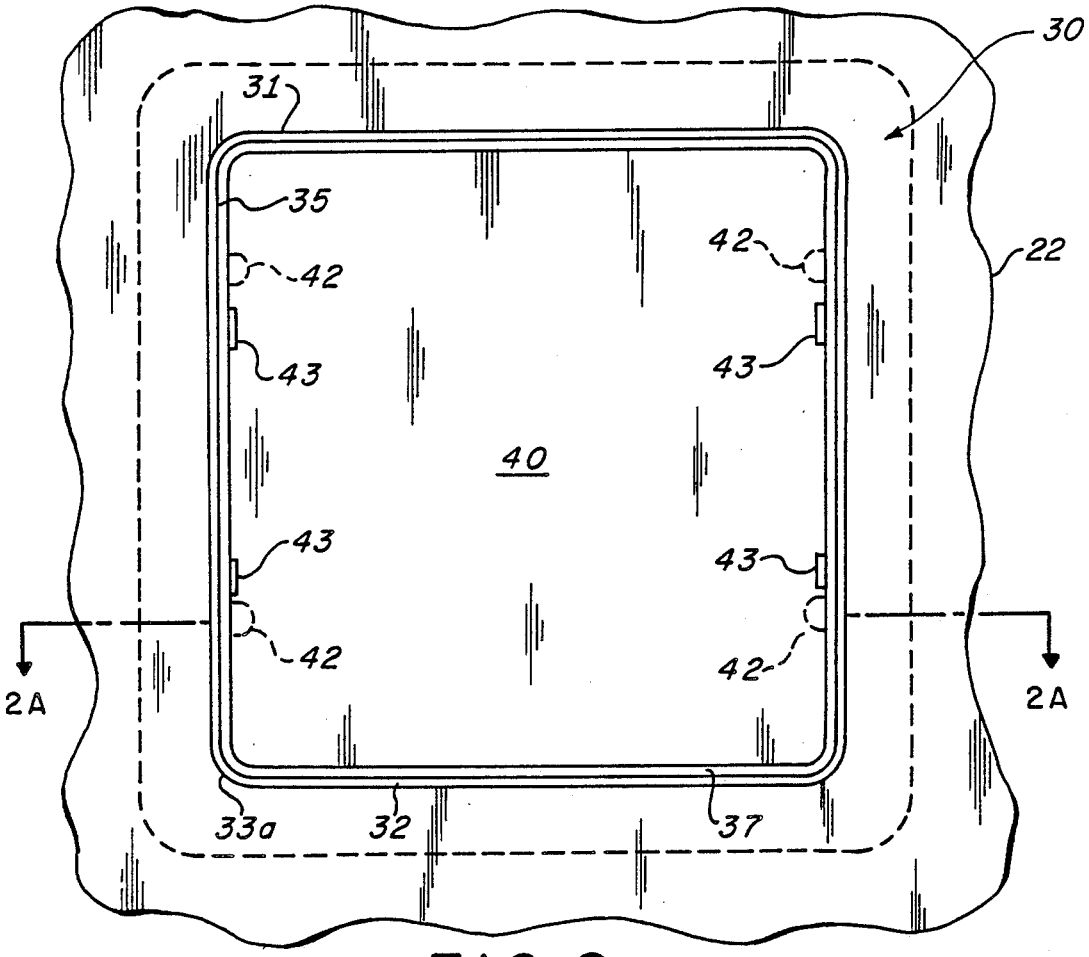
FIG. 2 illustrates the improved panel assembly installed in a new building structure.
Figure 2A:
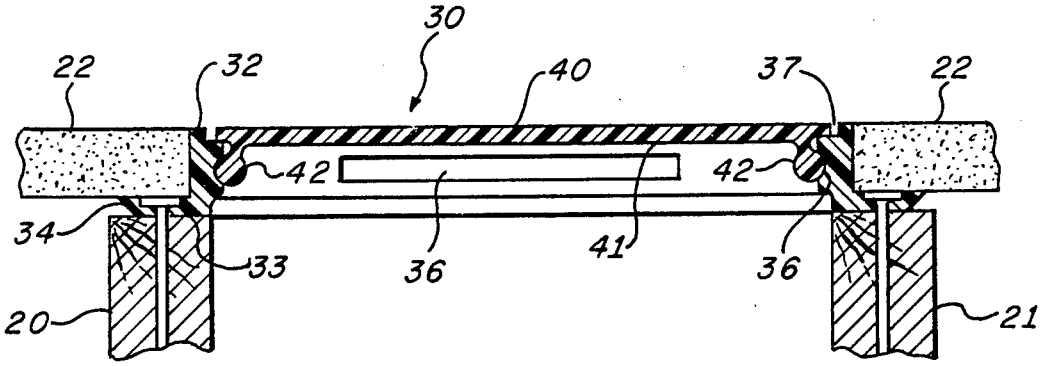
FIG. 2A is a sectional view of FIG. 2 illustrating the mounting of the multi-functional frame to joists and the surrounding surface-forming material.

FIG. 2 shows a preferred embodiment of the invention comprising an improved access panel assembly 30 formed of a single-piece, molded frame 31 fabricated with acrylonitrile butadiene styrene resin (ABS) or other high impact styrene. The frame 31, as more clearly illustrated in FIG. 2A, includes a narrow edge 32 and a wide edge 33 having rounded corners 33*a* and tapered edges 34 to remove the safety hazard presented by the sharp corners 12 and edges 13 of the prior art assembly 10 discussed above. Along the inner edge 35 of the frame 31 is a symmetrical shallow groove 36 equidistantly spaced from the two faces of the frame 31. The shallow groove 36 is formed in each of the four inner edges 35 of the frame 31 to provide easy alignment of a door 40 in the frame 31 for square assemblies.

The door 40 is fabricated from a single piece of the same material as the frame 31. Incorporated in the door 40 on its underside 41 proximate two of the four opposing edges of the door 40 are two pairs of molded protuberances 42, each pair being positioned opposite the other Each of these molded protruberances 42 is somewhat resilient to accomodate deflection when being press-fitted into the shallow grooved 36. The thickness of the door 40 is equal to the depth of the recess 37 on the frame 31 so that the door 40 and frame 31 provide a flush-fit panel assembly when the door 40 is press-fitted in the frame 31 from either side. The equidistant shallow groove 36 and the equally sized recess 37 in combination with the thickness of the door 40 provides the multi-functional feature of the frame 31 which allows the alternative installation of the door 40 from either face of the frame 31, i.e.,from either the narrow edge face 32 or the wide edge face 33.

The door 40 also includes four indentations or recesses 43 which are located in the outside surface of the door 40 near the molded protuberances 42. These indentations are suitable for receiving a tool such as a screw driver or a knife to pry the door 40 open after it has been press-fitted into the frame 31.

Figure 1A:
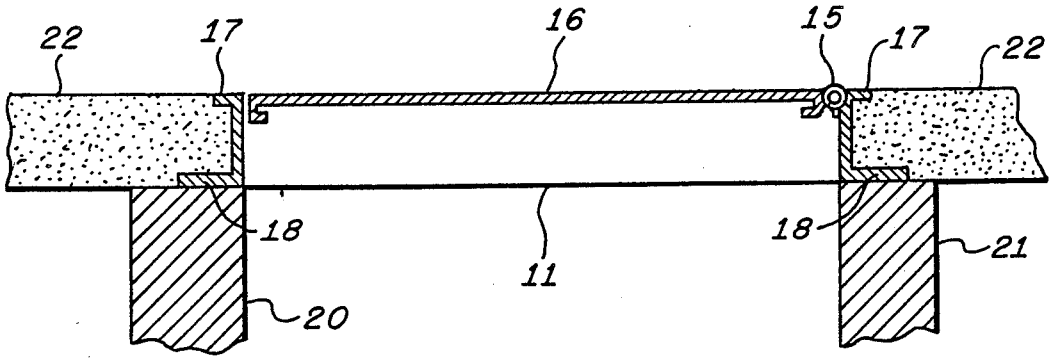
FIG. 1A is a sectional view of FIG. 1 illustrating the mounting of the frame to joists and the surrounding surfaceforming material.

When installing the multi-functional frame 31 in new construction, it is affixed to adjoining studs 20 and 21 in the same manner as the prior art unit 10 described above with respect to FIGS. 1 and 1A. The steps are basically the same except in many installations, the coloring and attractive appearance of the improved access panel assembly does not require painting because it can be color coordinated with the adjacent surface-forming material 22 or used in basic white. Additionally, if subsequently desired, it may also be painted.

Figure 3:
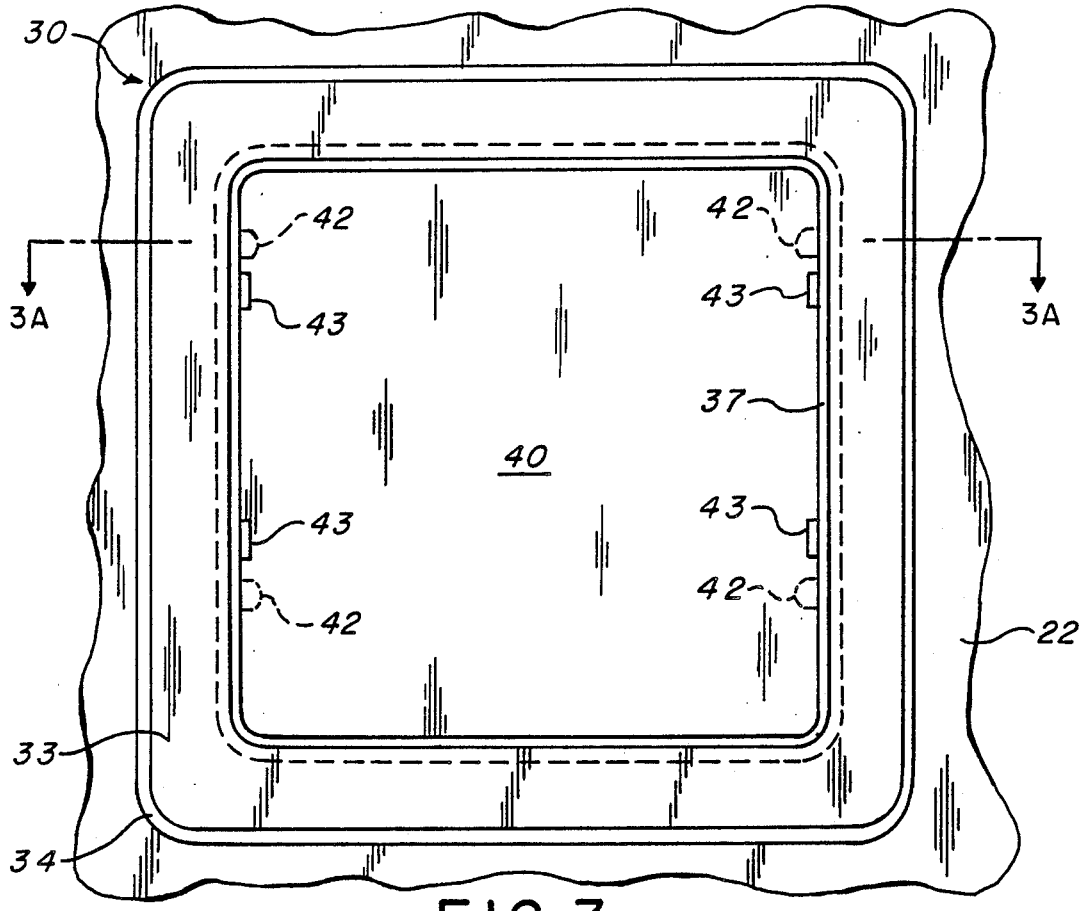
FIG. 3 illustrates the improved panel assembly installed in an existing building structure.
Figure 3A:
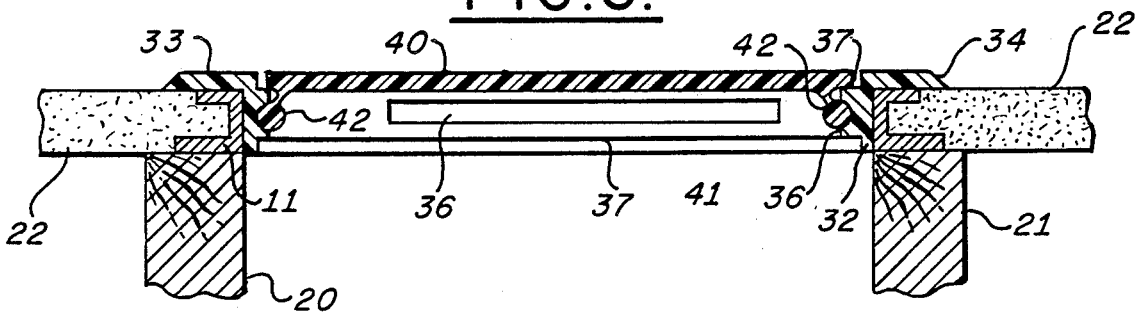
FIG. 3A is is a sectional view of FIG. 3 illustrating the insertion of the frame of the improved panel assembly in the frame of the prior art metallic unit.

In existing structures with installed prior art metallic assemblies, when the door 16 malfunctions due to warping, decomposing of spot welds 14 on the latch or piano-hinge 15, or is no longer affixed to the frame 11, the improved access panel assembly 30 may be readily installed. First, the door 16 and hinge 15, if either of them is still attached, are removed. The frame 31 of the improved assembly is rotated 180 degrees as compared to its orientation for new construction such that its narrow edge face 32 is inserted into the opening in the old frame 11 which is left in place as shown in FIG. 3A. The frame 31 may be secured within the old frame 11 by any suitable adhesive material such as an acrylonitrile based adhesive. The door 40 is then inserted into the opening in the frame 31 to form the flush-mounted door and frame access panel assembly 30. It follows that this new assembly 30 provides a unique and dramatic improvement to replacement of the damaged prior art metallic assembly 10 than was previously available with prior art units. This new improved assembly 30 has eliminated the need to completely dismantle and remove the entire prior art assembly 10 and the surrounding surface-forming material 22 as well as the time consuming task of replacing the surrounding surface-forming material 22. When used as described, the new assembly 30 provides a significant reduction in time, materials, and cost over prior art replacement units.

Figure 3B:
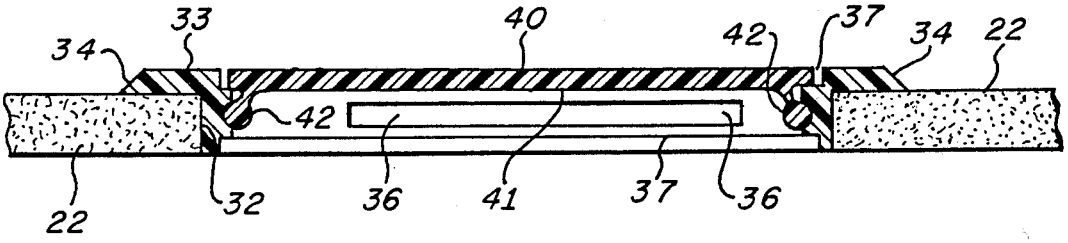
FIG. 3B is a sectional view of FIG. 3 illustrating an alternative mounting of the improved panel assembly directly in a surface-forming material of an existing structure.

An additional advantage provided by the improved panel assembly 30 is its use in directly mounting the frame 31 to the lsurrounding surface-forming material 22 when there are no studs or joists within the area that an access panel is desired to be mounted. This alternate mounting feature of the new assembly 30 is illustrated in FIG. 3B. It will be noted that the frame 31 is oriented in the same manner as that shown in FIG. 3A,i.e., the narrow edge face 32 is inserted into the opening made in the surface–forming material 22 and the wide edge face 33 rests atop the surface–forming material 22. The frame 31 is secured to the surface-forming material 22 with a suitable adhesive material and the door 40 is press-fitted into the frame 31 opening with the protuberances 42 engaging the shallow grooves on opposite sides of the opening to hold the door 40 firmly in place within the frame 31.

In conclusion, the improved access panel assembly 30 is a novel structure comprising a single-piece, molded door 40 and a multi-functional, single-piece, molded frame 31 with a unique locking mechanism consisting of shallow grooves 36 molded into the frame 31 and pairs of resilient protuberances 42 molded into the door 40. The location of the shallow grooves 36 equidistant between the opposing faces of the frame 31 and the equal depths of the recesses from both the narrow edge face 32 and the wide edge face 33 being equal to the thickness of the door 40 enables the door 40 to be flush-mounted to either face of the frame 31 thereby combing with the other novel features of this assembly 30 to provide a significant improvement over prior art panel assemblies.

What is claimed is:

1. An improved access panel assembly comprising;

a frame including a narrow edge face and a wide edge face for being mounted within a surface of a building structure;

a door suitable for being press-fitted within said frame; and securing means incorporated in said frame and said door for enabling said door to be flush-mounted with either the narrow edge face or the wide edge face of said frame thereby holding said door firmly within said frame.

2. An improved access panel assembly as recited in claim 1 in which said securing means includes resilient protuberances incorporated in said door and shallow grooves incorporated in said frame.

3. An improved access panel assembly as recited in claim 2 in which the resilient protuberances are incorporated in the underside of said door and the shallow grooves are equidistant from the narrow edge face and the wide edge face of said frame.

4. An improved access panel assembly as recited in claim 3 in which said securing means is an integral part of said door formed in the fabrication of said door and the shallow grooves are an integral part of said frame formed in the fabrication of said frame.

5. An improved access panel assembly as recited in claim 4 in which said frame and said door are fabricated of a plastic composition material highly resistant to damage from environmental conditions, particularly water and humidity.

6. An improved access panel assembly as recited in claim 5 in which said frame, said door, and said securing means are fabricated of a high impact resistant material.

7. An improved access panel assembly as recited in claim 6 in which said high impact resistant material is styrene.

8. An improved access panel assembly as recited in claim 7 in which said high impact resistant material is acrylonitrile butadiene styrene resin (ABS).

9. An improved access panel assembly as recited in claim 4 in which said shallow grooves are formed in projections along the inner edges of said frame.

10. An improved access panel assembly as recited in claim 9 in which said projections have parallel sides, each side of which is located an equal distance from the respective narrow edge face and wide edge face of said frame.

11. An improved access panel assembly as recited in claim 10 in which said door has a thickness equal to the distance of said parallel sides of the projections from the respective narrow edge face and wide edge face of the frame.

12. An improved access panel assembly as recited in claim 11 in which said frame and said door include rounded edges and corners to provide a safer and more easily installed assembly.

* * * * *